US012644071B2

(12) United States Patent
Simmons, Jr. et al.

(10) Patent No.: US 12,644,071 B2
(45) Date of Patent: Jun. 2, 2026

(54) COMPOSITIONS, METHODS OF USE AND MANUFACTURE THEREOF, AND SYSTEM FOR GENERATING HIGH-LUBRICITY SUBSTANCES FOR LUBRICATION OF A MECHANICAL DEVICE

(71) Applicant: United Protective Technologies, LLC, Locust, NC (US)

(72) Inventors: Timothy Curtis Simmons, Jr., Charlotte, NC (US); Cantwell George Carson, Pittsburgh, PA (US); Scott Haynes, Monroe, NC (US)

(73) Assignee: United Protective Technologies, LLC, Locust, NC (US)

( * ) Notice: Subject to any disclaimer, the term of this patent is extended or adjusted under 35 U.S.C. 154(b) by 0 days.

(21) Appl. No.: 18/797,375

(22) Filed: Aug. 7, 2024

(65) Prior Publication Data

US 2025/0051682 A1 Feb. 13, 2025

Related U.S. Application Data

(60) Provisional application No. 63/531,295, filed on Aug. 7, 2023.

(51) Int. Cl.
*C10M 177/00* (2006.01)
*C10M 103/02* (2006.01)
(Continued)

(52) U.S. Cl.
CPC ..... *C10M 177/00* (2013.01); *C10M 103/02* (2013.01); *C10M 127/00* (2013.01);
(Continued)

(58) Field of Classification Search
CPC ..... C10M 177/00; C10M 103/02; C10M 127/00; C10M 2201/0413; C10M 2203/00;
(Continued)

(56) References Cited

U.S. PATENT DOCUMENTS 5,282,444 A 2/1994 Ito et al.
8,222,190 B2 * 7/2012 Zhamu ..... C10M 103/02 508/113
(Continued)

OTHER PUBLICATIONS

International Search Report issued in International Patent Application No. PCT/US2024/041368 on Dec. 12, 2024, 8 pages.
(Continued)

*Primary Examiner* — Ellen M McAvoy
(74) *Attorney, Agent, or Firm* — Bradley Arant Boult Cummings LLP; Henry B. Ward, III

(57) ABSTRACT

A system is provided for creating a high lubricity substance from a fuel while said fuel is being used to operate a mechanical device such as an engine, thereby increasing the lubricity the fuel and allowing the fuel to be used as a lubricant for various tribological surfaces inside the engine without the use of further additives or modifiers. In this regard, an embodiment of the present disclosure may include a device that has a first surface upon which is deposited a film. The first surface of the device and the associated film may be in continual contact with a fuel. The device may comprise a second surface that is brought into periodic and/or repeated contact with the first surface, such as through sliding contact, rolling contact, a combination of the two, and/or the like.

20 Claims, 6 Drawing Sheets

(51) Int. Cl.
*C10M 127/00* (2006.01)
*C10N 20/02* (2006.01)
*C10N 40/25* (2006.01)

(52) U.S. Cl.
CPC . *C10M 2201/0413* (2013.01); *C10M 2203/00* (2013.01); *C10N 2020/02* (2013.01); *C10N 2040/25* (2013.01)

(58) Field of Classification Search
CPC ..... C10M 169/04; C10M 2201/041; C10M 2201/05; C10M 2201/061; C10M 2203/10; C10N 2020/02; C10N 2040/25; C10N 2030/02; C10N 2030/06; C10N 2040/02; C10N 2050/025
See application file for complete search history.

(56) References Cited

U.S. PATENT DOCUMENTS 10,696,916 B2 * 6/2020 Aswath ..... C10M 137/10
11,001,922 B2 * 5/2021 Barbee ..... C23C 16/0245
11,091,369 B2 * 8/2021 Hunter ..... C10M 103/02
2005/0089685 A1 * 4/2005 Hamada ..... F01M 9/04 428/408
2008/0070815 A1 * 3/2008 Kamada ..... C10M 171/06 508/109
2011/0046027 A1 2/2011 Zhamu et al.
2013/0319365 A1 * 12/2013 Becker ..... C10M 125/22 427/230
2014/0134092 A1 * 5/2014 Shankman ..... B82Y 30/00 423/448
2014/0295128 A1 10/2014 Sykora et al.
2015/0099123 A1 4/2015 Barbee et al.
2016/0138502 A1 5/2016 Bullister et al.
2017/0306258 A1 * 10/2017 Wang ..... C10M 129/32
2017/0327761 A1 11/2017 Aswath et al.
2020/0131957 A1 4/2020 Doll et al.
2024/0240103 A1 * 7/2024 James ..... C10M 107/02

OTHER PUBLICATIONS

Written Opinion issued in International Patent Application No. PCT/US2024/041368 on Dec. 12, 2024, 13 pages.

* cited by examiner

500

| | | | | | | | |
|---|---|---|---|---|---|---|---|
| Sample Name | : None | Scan Mode | : STEP | CBO selection slit | : BB | | |
| Comment | : None | Duration Time | : 5.0 sec | Incident parallel slit | : Soller_slit_5.0deg | | |
| | | Scan Step | : 0.0500 deg | Incident slit | : 2/3deg | | |
| Date | : 05/18/23 08:18:50 | Scan Axis | : Theta/2-Theta | Length limiting slit | : 10.0mm | | |
| Operator | : administrator | Scan Range | : 5.0000 - 90.0000 deg | Receiving slit # 1 | : 2/3deg | | |
| X-Ray | : 40 kV , 44 mA | 2-Theta | : 5.0000 deg | Filter | : None | | |
| Wavelength | : CuKa / 1.541862 A | Omega | : 2.5000 deg | Receiving optical device | : PSA_open | | |
| Goniometer | : SmartLab | Chi | : | Receiving parallel slit | : Soller_slit_5.0deg | | |
| Base Att. Config. | : Standard Z stage | | : | Receiving slit # 2 | : 0.600mm | | |
| Attachment | : Standard | 2-ThetaChi | : | Attenuator | : 1/1.0000 | | |
| Detector | : SC-70 | | | Diffracted beam mono. | : Bent | | |
| Memo | : None | | | Monochromator slit | : BBM | | |
| Optics Attribute | : Bragg-Brentano focusing | | | | | | |

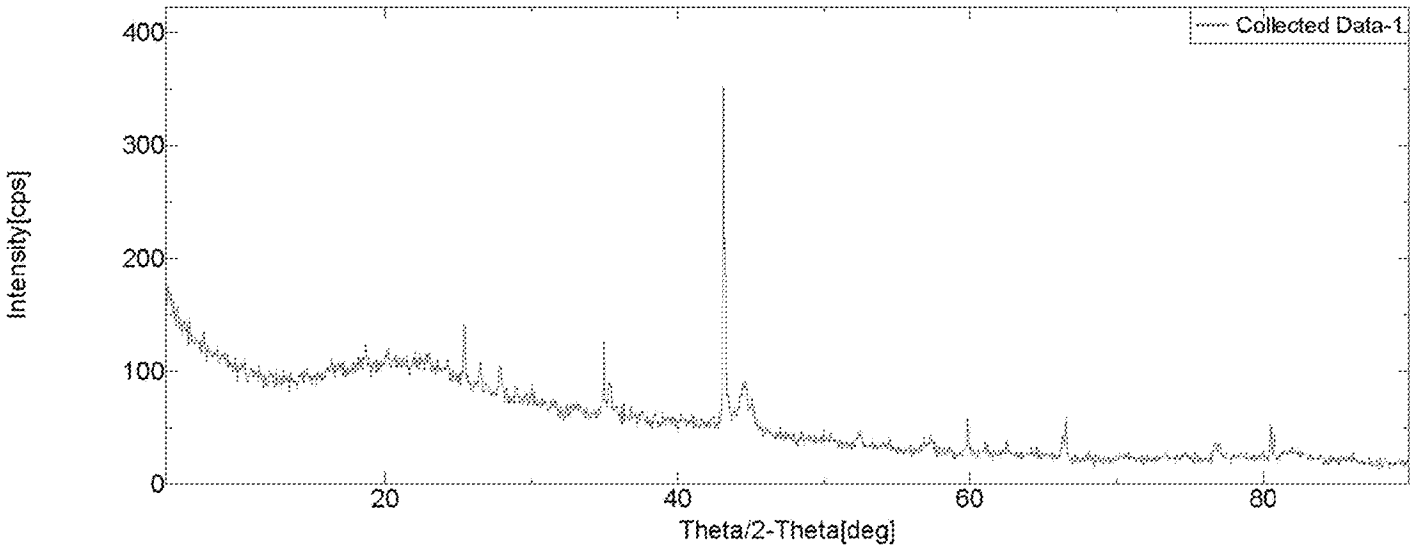

FIG 6

COMPOSITIONS, METHODS OF USE AND MANUFACTURE THEREOF, AND SYSTEM FOR GENERATING HIGH-LUBRICITY SUBSTANCES FOR LUBRICATION OF A MECHANICAL DEVICE

CROSS-REFERENCES TO RELATED APPLICATIONS

This is a non-provisional patent application claiming priority to provisional patent application No. 63/531,295 filed Aug. 7, 2023, and titled "System for Generating High-Lubricity Substances for Lubrication of a Mechanical Device."

GOVERNMENT RIGHTS

This invention was made with government support under contract number W91CRB21P0013 awarded by the U.S. Department of the Army. The government has certain rights in the invention.

TECHNICAL FIELD

The present disclosure relates generally to lubrication of a mechanical device. More particularly, the present disclosure pertains to a system for generating high-lubricity substances for lubrication of a mechanical device.

BACKGROUND

Engines such as internal combustion engines are used in a wide range of applications, from powering automobiles to generating electricity. These engines rely on a steady supply of fuel, which is typically a hydrocarbon-based substance such as gasoline, diesel, or aviation fuel. However, these fuels can be prone to low lubricity, meaning that they do not provide sufficient lubrication for the moving parts inside the engine. To provide this lubrication, a separate system is often needed to supply lubricants, often a long hydrocarbon-based oil, to critical wear surfaces. This oil provides protection from wear and tear on the engine, but also reduces fuel efficiency, increases emissions, and increases maintenance.

The need for these lubricants in the engine requires either that they be added as additives into the fuel source or that a specialized system be incorporated to circulate the lubricant into critical wear surfaces during operation. This need for lubrication can result in substantial difficulties for operators. Either a specialized additional lubricant has to be sourced and added to the fuel in specific ratios or the weight and complexity of a lubrication pump and recirculation system has to be incorporated into the design of the engine. When lubricant recirculation systems are used, the lubricant requires periodic drain, flush and refill due to its life and the components of the system may require maintenance to operate the engine. In either case, combustion, or overheating of the lubricant, which occurs frequently in the engine system, can significantly increase emissions and cause extensive engine deposits that can reduce efficiency and lead to shortened engine life. Further, lubricant leakage from the engine, or during lubricant handling can require extensive remediation to reduce environmental damage.

In order to address these issues, there is a need for a system that can increase the lubricity of the fuel and improve the performance and efficiency of engines, or mechanical systems without the use of additives nor specialized lubricants.

There are several variables which have been cited in the prior art as causing an increase in fuel lubricity, including the chemical composition of the fuel, the viscosity, and the presence of $3^{rd}$ bodies.

Heavy aromatic hydrocarbons, such as polycyclic aromatic hydrocarbons (PAH) and nitrogen heterocyclic polyaromatic hydrocarbons (NPAH), are the main source of lubricity in petroleum distillate motor fuels. These chemicals bond to metal surfaces creating slip planes due to their geometry. There is typically a proportional relationship between the fuel boiling point and the concentration of these chemistries and thus the lubricity of diesel fuel is greater than the lubricity of kerosene, which is greater than the lubricity of gasoline. While diesel is more lubricious than the others cited, it is typically under much higher pressure and several biodiesels do not contain these hydrocarbons and therefore there may be increased more wear in diesel applications.

Fluid viscosity is critical for lubricity and lower wear because it provides hydrodynamic forces which separate the two surfaces while moving in relation to each other. Essentially causing the interfacing surfaces to glide along the surface of the fluid rather than interfacing with the counter surface.

Finally, $3^{rd}$ body particles act to form a solid lubricant boundary layer between the surfaces filling in surface roughnesses and creating slip planes for higher pressure interfaces. These typically result in lower friction and wear.

The addition of graphite to a lubrication system has been shown to improve lubricity, increase power and reduce wear.

It is therefore desirable to create a method for increasing the lubricity of fuel by catalyzing a reaction that increases the concentration of heavy aromatic hydrocarbons, increases viscosity, and/or produces $3^{rd}$ bodies in the fuel.

BRIEF SUMMARY

The following presents a simplified summary of one or more embodiments of the present disclosure, in order to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments of the present invention in a simplified form as a prelude to the more detailed description that is presented later.

Accordingly, a first embodiment provides a method for generating high-lubricity substances for lubrication of a mechanical device, the method comprising providing a first component operatively coupled to the mechanical device, wherein the mechanical device is an engine, the first component comprising a surface having a film deposited thereon; operating the engine on a fuel, wherein operating the engine comprises exposing the film to the fuel to generate a high lubricity substance on a surface of the film; suspending at least a portion of the high lubricity substance within the fuel; conveying, via the fuel, the at least a portion of the high lubricity substance to a second component operatively coupled to the engine; and lubricating the second component using the at least a portion of the high lubricity substance.

In a first aspect of the first embodiment, generating the high lubricity substance on the surface of the film further comprises positioning the fuel between the film on the surface of the first component and a surface of a third component operatively coupled to the engine; and bringing the film on the surface of the first component into contact with the surface of the third component.

In a second aspect, alone or in combination with the first aspect of the first embodiment, the first component and the third component are integral components within the engine.

In a third aspect, alone or in combination with any of the previous aspects of the first embodiment, the first component is a cylinder liner of a cylinder within the engine, wherein the third component is a piston or piston ring positioned within the cylinder.

In a fourth aspect, alone or in combination with any of the previous aspects of the first embodiment, the first component is housed in a device that is operatively coupled to the engine.

In a fifth aspect, alone or in combination with any of the previous aspects of the first embodiment, the device is located outside of the engine, wherein the first component is located substantially within a fuel path of a fuel delivery system of the engine.

In a fifth aspect, alone or in combination with any of the previous aspects of the first embodiment, the device is located outside of the engine, wherein the first component is located substantially within a fuel path of a fuel delivery system of the engine.

In a sixth aspect, alone or in combination with any of the previous aspects of the first embodiment, the high lubricity substance is a suspension comprising one or more allotropes of carbon.

In a seventh aspect, alone or in combination with any of the previous aspects of the first embodiment, the high lubricity substance is a suspension of graphitic structures in the fuel.

In an eighth aspect, alone or in combination with any of the previous aspects of the first embodiment, the second component is a bearing, valvetrain component, or cam surface.

In a ninth aspect, alone or in combination with any of the previous aspects of the first embodiment, the film comprises copper and molybdenum nitride with a ratio of copper to molybdenum of between 1:30 and 1:2.

A second embodiment provides a system for generating high-lubricity substances for lubrication of a mechanical device, the system comprising the mechanical device, wherein the mechanical device is an engine; a first component operatively coupled to the engine, wherein a surface of the first component has a film deposited thereon; a second component operatively coupled to the engine, wherein the second component comprises a surface in moving contact with a surface of the film; and a third component operatively coupled to the engine; wherein the film, when placed into contact with the second component with the fuel positioned between a surface of the film and the surface of the second component, generates a high lubricity substance on a surface of the film; wherein at least a portion of the high lubricity substance is suspended in the fuel in the engine.

In a first aspect of the second embodiment, the first component and the second component are integral components within the engine.

In a second aspect of the second embodiment, alone or in combination with the first aspect or embodiments, the first component is a cylinder liner of a cylinder within the engine, wherein the second component is a piston or piston ring positioned within the cylinder.

In a third aspect of the second embodiment, alone or in combination with any of the previous aspects or embodiments, the first component and the second component are housed in a device that is operatively coupled to the engine.

In a fourth aspect of the second embodiment, alone or in combination with any of the previous aspects or embodiments, the device is located outside of the engine, wherein the first component and the second component are located substantially within a fuel path of a fuel delivery system of the engine.

In a fifth aspect of the second embodiment, alone or in combination with any of the previous aspects or embodiments, the high lubricity substance is a suspension comprising one or more allotropes of carbon.

In a sixth aspect of the second embodiment, alone or in combination with any of the previous aspects or embodiments, the high lubricity substance is a suspension of graphitic structures in the fuel.

In a seventh aspect of the second embodiment, alone or in combination with any of the previous aspects or embodiments, the third component is a bearing, valvetrain component, or cam surface.

In an eighth aspect of the second embodiment, alone or in combination with any of the previous aspects or embodiments, the film comprises copper and molybdenum nitride.

In a ninth aspect of the second embodiment, alone or in combination with any of the previous aspects or embodiments, a ratio of copper to molybdenum is between I:30 and I:2.

The above summary is provided merely for purposes of summarizing some example embodiments to provide a basic understanding of some aspects of the present disclosure. Accordingly, it will be appreciated that the above-described embodiments are merely examples and should not be construed to narrow the scope or spirit of the disclosure in any way. It will be appreciated that the scope of the present disclosure encompasses many potential embodiments in addition to those here summarized, some of which will be further described below.

BRIEF DESCRIPTION OF THE DRAWINGS

Having thus described embodiments of the disclosure in general terms, reference will now be made the accompanying drawings. The components illustrated in the figures may or may not be present in certain embodiments described herein. Some embodiments may include fewer (or more) components than those shown in the figures.

Figure 1:
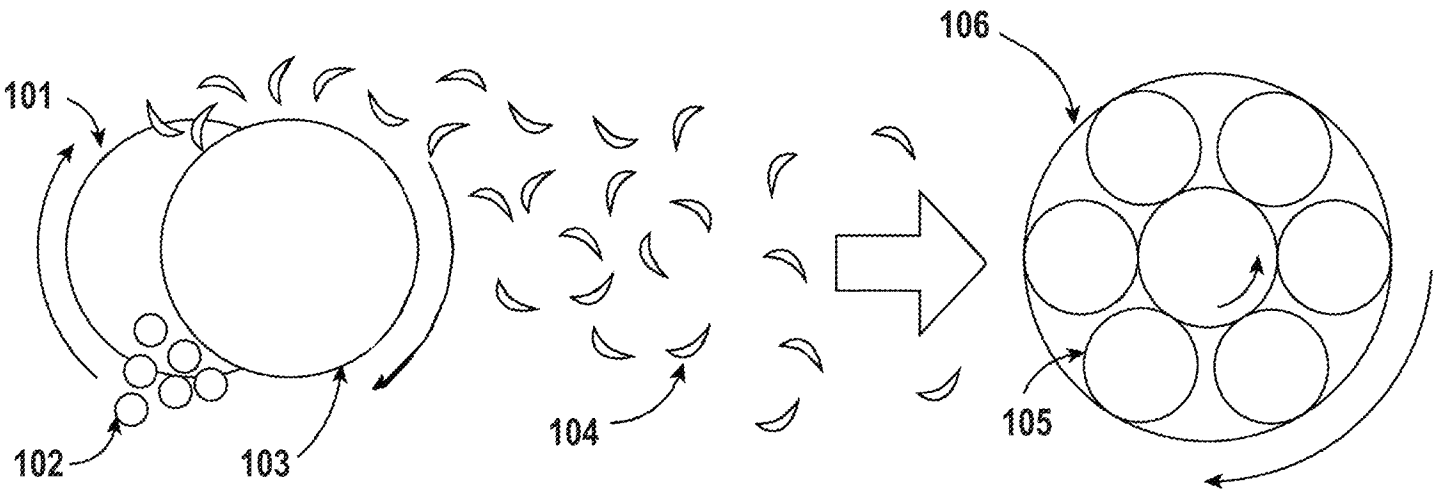
Figure 2:
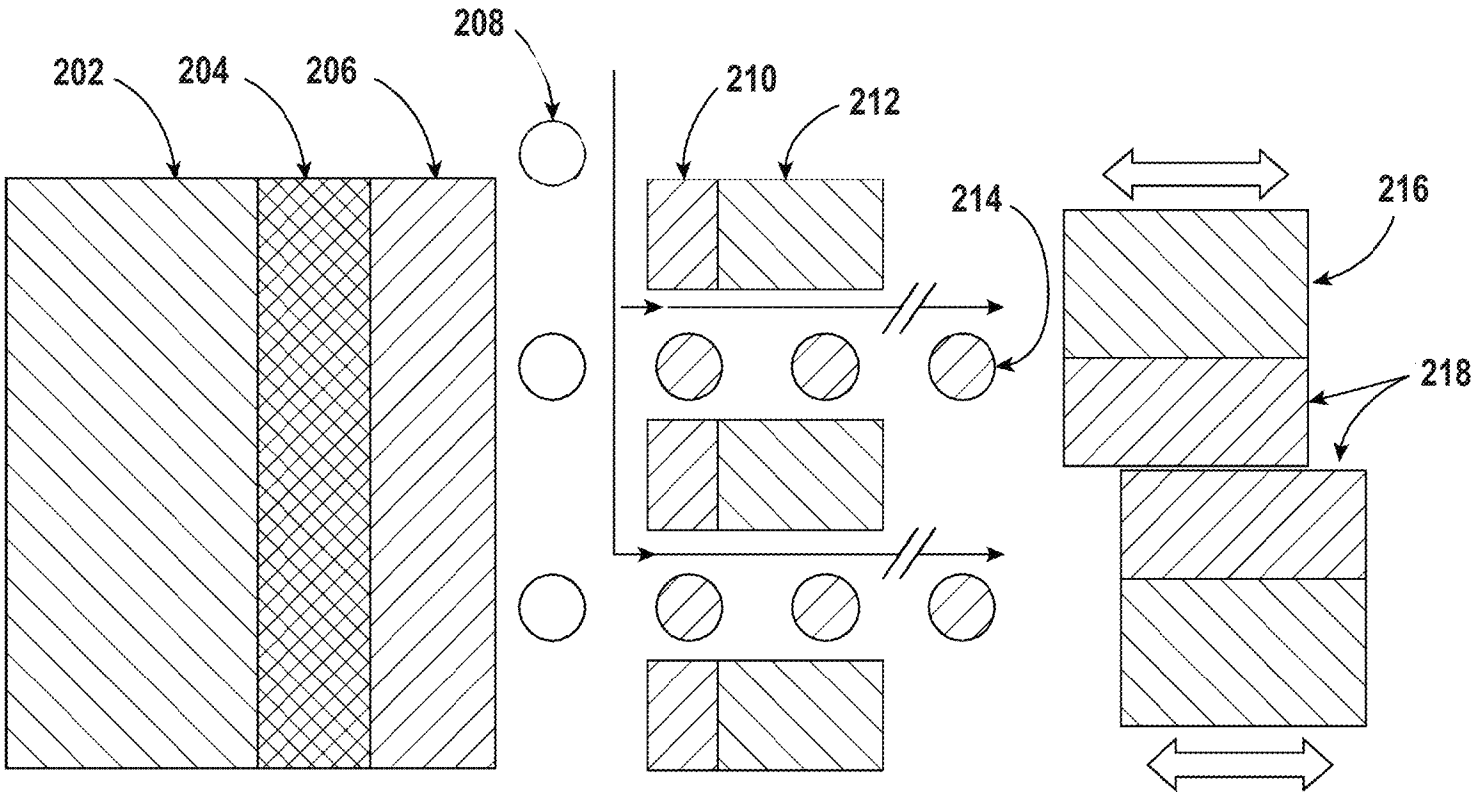
Figure 3:
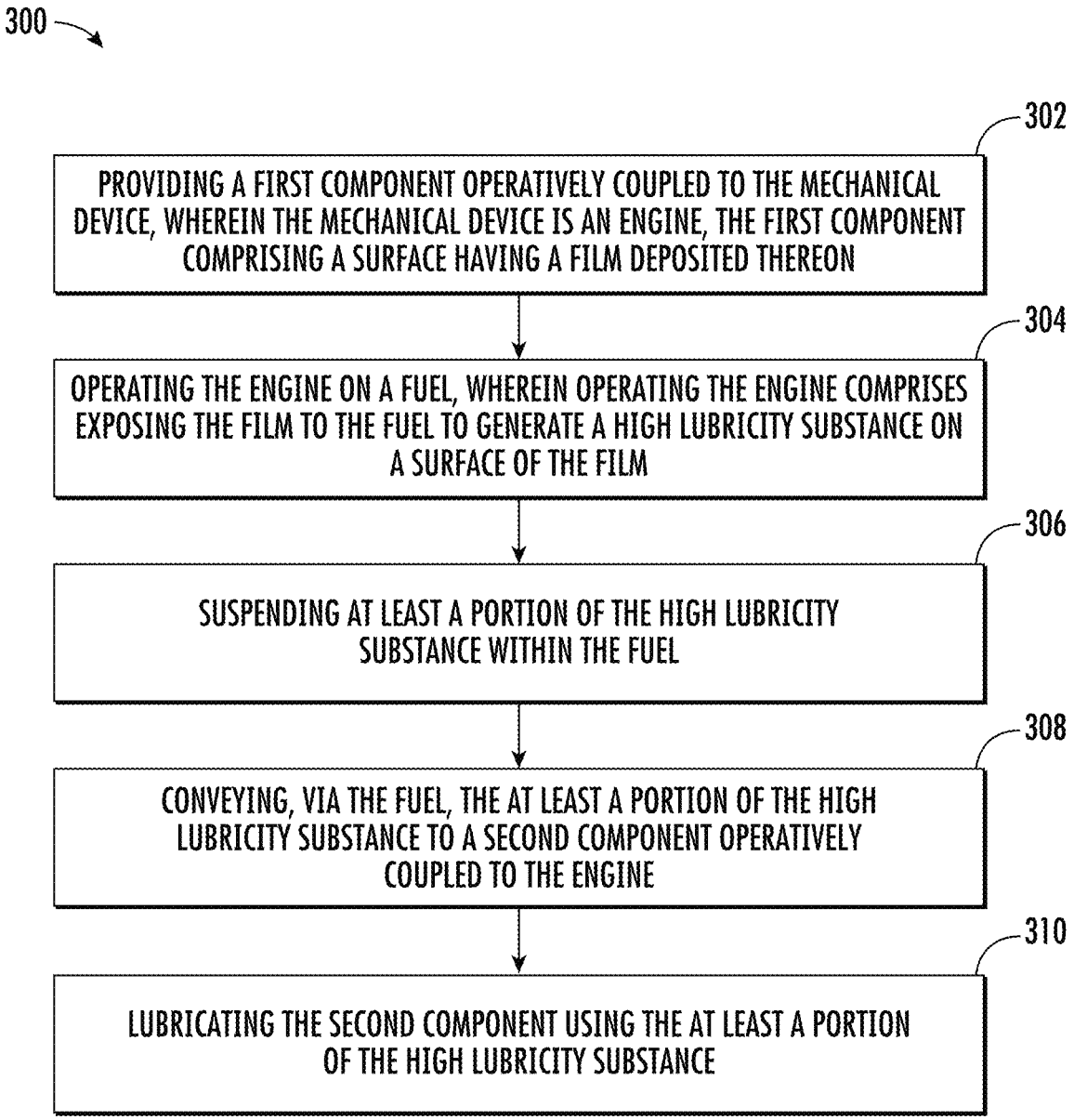

FIG. 1 illustrates a system for generating high-lubricity substances for lubrication of a mechanical device, in accordance with an embodiment of the disclosure;

FIG. 2 illustrates a mechanism for transport of a high lubricity substance, m accordance with an embodiment of the disclosure; and FIG. 3 illustrates a method for generating high-lubricity substances for lubrication of a mechanical device, in accordance with an embodiment of the disclosure.

Figure 4:
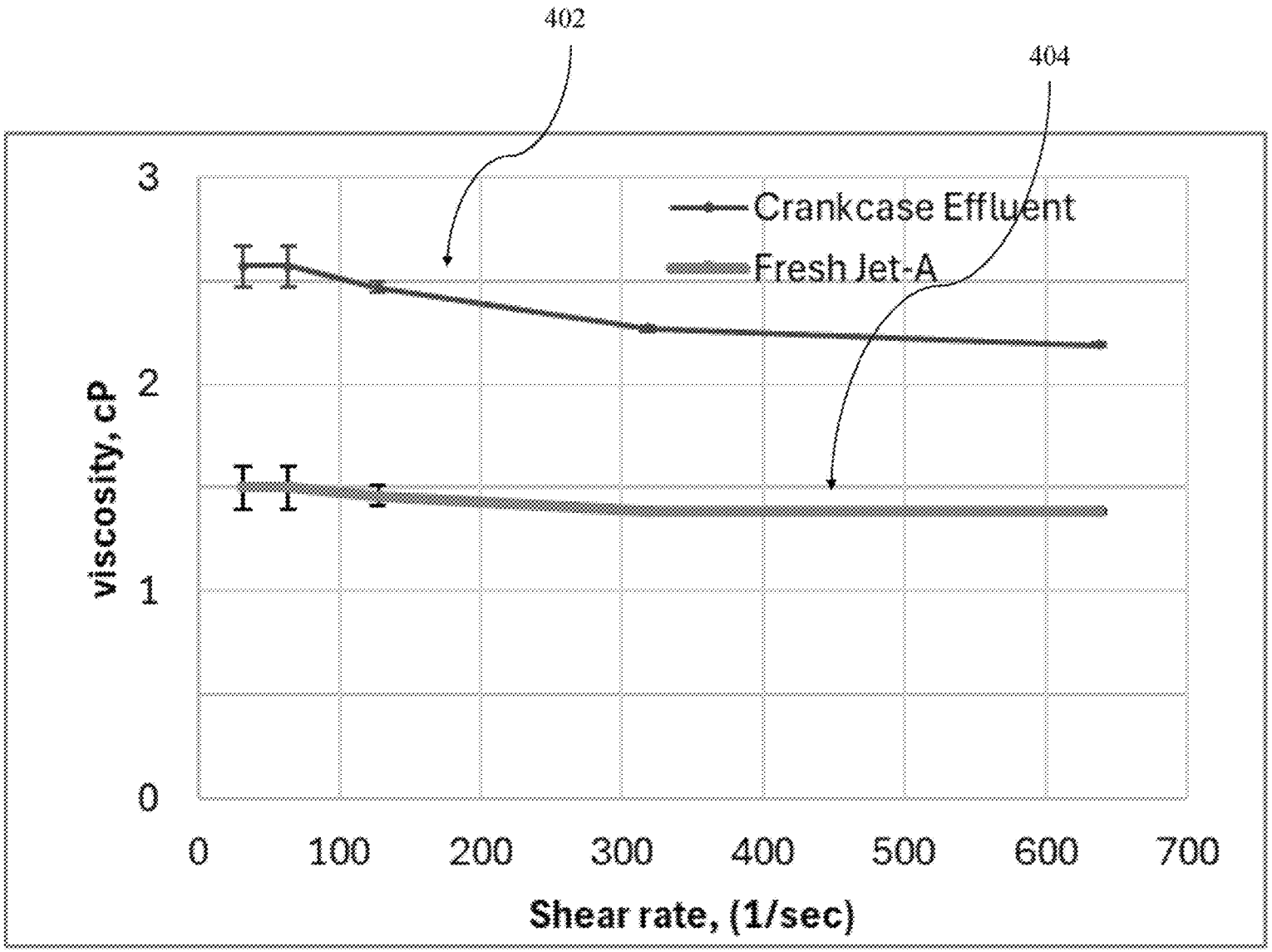

FIG. 4 is a plot of data from a cone-and-plate viscometry test for a hydrocarbon fuel which has not been in contact with the claimed film and for a crank case effluent from a system in which a component of the mechanical device was coated with the claimed film.

Figure 5:
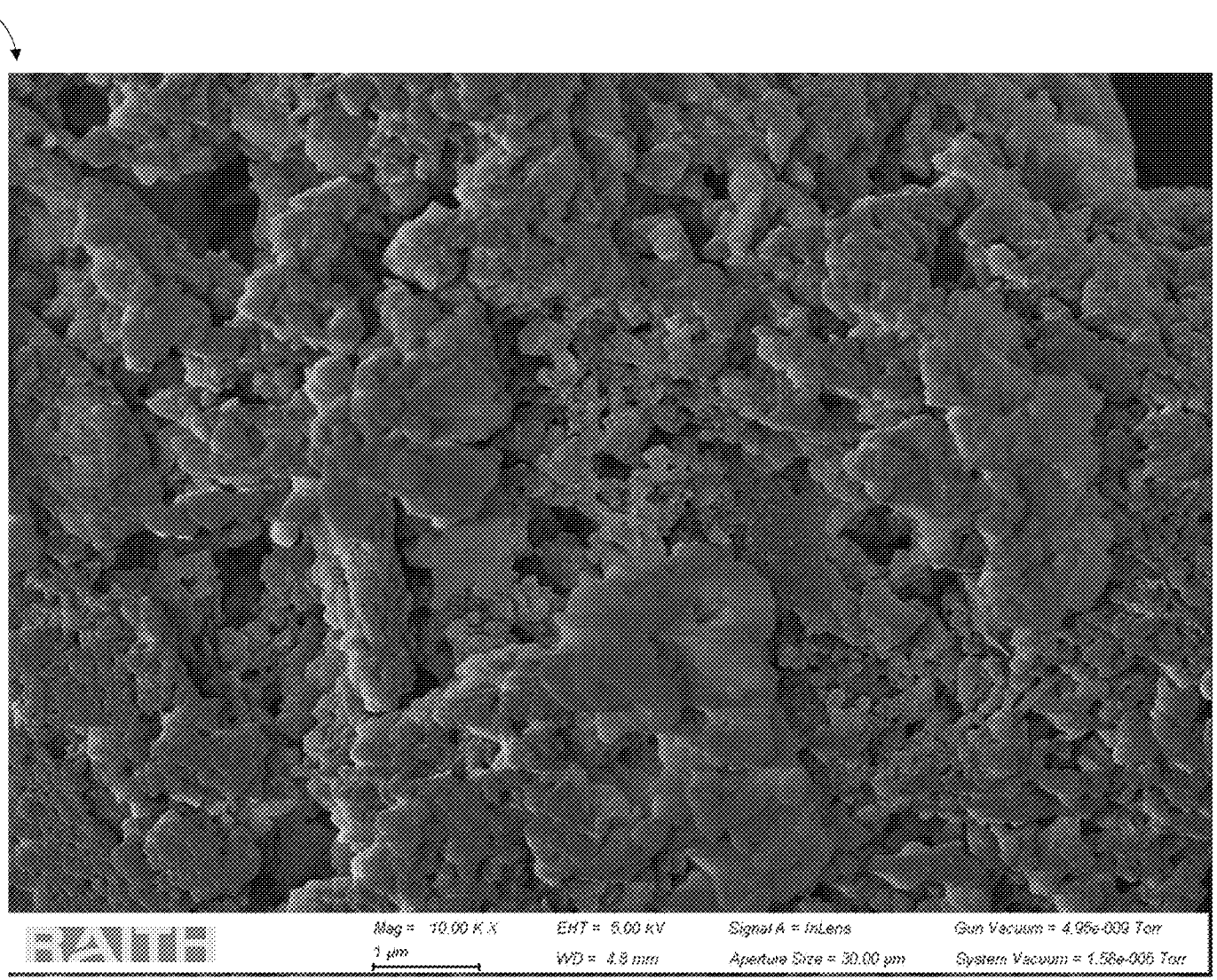

FIG. 5 is a scanning electron microscope (SEM) image of the high lubricity substances formed in a fuel mixture after contact with the claimed film.

FIG. 6 is a graph of the x-ray diffraction (XRD) pattern of a high lubricity substance present in an effluent stream according to an exemplary embodiment of the claimed invention.

DETAILED DESCRIPTION

Embodiments of the present disclosure will now be described more fully hereinafter with reference to the accompanying drawings, in which some, but not all, embodiments of the disclosure are shown. Indeed, the disclosure may be embodied in many different forms and should not be construed as limited to the embodiments set forth herein; rather, these embodiments are provided so that this disclosure will satisfy applicable legal requirements. Where possible, any terms expressed in the singular form herein are meant to also include the plural form and vice versa, unless explicitly stated otherwise. Also, as used herein, the term "a" and/or "an" shall mean "one or more," even though the phrase "one or more" is also used herein. Furthermore, when it is said herein that something is "based on" something else, it may be based on one or more other things as well. In other words, unless expressly indicated otherwise, as used herein "based on" means "based at least in part on" or "based at least partially on." Like numbers refer to like elements throughout.

As used herein, "film" or "coating" may refer to any continuous or non-continuous material that may be formed, deposited, layered, or placed on or adjacent to a surface of a structure. In some embodiments, a film may comprise nanomaterials such as nanoparticles, nanosheets, nanolayers, or other such nanostructures.

As used herein, "effluent" may refer to any liquid discharge that flows out of a mechanical device using the claimed method.

As used herein, "viscosity" refers to a fluid's resistance to deformation or flow. It describes how "thick" or "thin" a fluid is and quantifies its internal friction.

Embodiments of the present disclosure provide a system for creating a high lubricity substance from a fuel (e.g., a hydrocarbon-containing fuel) while said fuel is being used to operate a mechanical device such as an engine (e.g., an internal combustion engine such as a piston engine, turbine engine, rotary engine, jet engine, and/or the like), thereby increasing the lubricity the fuel and allowing the fuel to be used as a lubricant for various tribological surfaces inside the engine without the use of further additives or modifiers. In this regard, an embodiment of the present disclosure may include a device that has a first surface upon which is deposited a film. The first surface of the device and the associated film may be in continual contact with a fuel (e.g., a hydrocarbon fuel that is intended to be used inside of an internal combustion engine). The fuel may be a hydrocarbon-based fluid such as gasoline, diesel, biodiesel, jet fuel or aviation fuel, kerosene, and/or the like. The device may comprise a second surface that is brought into periodic and/or repeated contact with the first surface, such as through sliding contact, rolling contact, a combination of the two, and/or the like. While reference is made to generating the high-lubricity substance inside of an engine, it should be understood that the processes described herein may further be applicable to lubricate other types of components (e.g., bearings, pumps, cams, other mechanical interfaces) in other types of mechanical devices.

In one embodiment, the film may be a nanocomposite coating comprising a metal M and/or metal nitride (e.g., taking the form of MaNx). In some embodiments, metal M may be selected from a group consisting essentially of the metals Cu, Ni, Sc, Y, Ti, Zr, Hf, V, Nb, Ta, Cr, Mo, Ag, Au, Pd, Zn, Cd, Hg, Al, Ga, In, Pt, and W, and combinations thereof. In an exemplary embodiment, the film may comprise a combination of molybdenum nitride and copper and/or copper nitride. For instance, the film may comprise molybdenum nitride particles interspersed with copper. In some embodiments, the film may comprise a copper molybdenum nitride of the form CuaMobNx. The film may comprise a combination of about 50 to 99.7 wt. % of molybdenum and about 50 to 0.3 wt. % copper. In another embodiment, the film may comprise a combination of about 70 to 95 wt. % of molybdenum and about 30 to 3 wt. % copper. In yet another embodiment, the film may comprise a combination of about 75 to 90 wt. % of molybdenum and about 8 to 25 wt. % copper. In yet another embodiment, the film may comprise a combination of about 80 to 85 wt. % of molybdenum and about 13 to 20 wt. % copper. In some embodiments, the ratio of copper to molybdenum by wt. % may be between 1:30 and 1:2. The film may be deposited on the surface of the component according to the operating tolerances of the components within the machine or device (e.g., to prevent binding or undue friction caused by the addition of the film). Accordingly, in some embodiments, the thickness of the film may range from about 0.1 micron to about 40 microns. In other embodiments, the thickness of the film may range from about 1 micron to about 10 microns. In yet other embodiments, the thickness of the film may range from about 3 to about 6 microns.

The film may be deposited onto the surface of one or more components of a machine or device such as an engine (or any other surface or substrate) by various techniques, including without limitation, physical vapor deposition ("PVD"), cathodic arc deposition ("Arc-PVD"), evaporative deposition, sputtering and/or magnetron sputtering, chemical vapor deposition ("CVD"), hybrid plasma enhanced CVD ("PECVD"), low pressure or ultrahigh vacuum CVD ("LPCVD" or "UHVCVD"), and/or the like. In an exemplary embodiment, a film comprising copper and molybdenum nitride may be deposited onto a substrate (e.g., an internal component of an internal combustion engine) using PECVD. In such an embodiment, the substrate may be placed in a low-pressure reaction chamber between a cathode and anode. For instance, the reaction chamber may have an internal pressure ranging from about 0.005 Torr to 10 Torr. In other embodiments, the pressure of the reaction chamber may range from about 0.05 Torr to 5 Torr. In yet other embodiments, the pressure of the reaction chamber may range from about 1 Torr to 2 Torr. In some embodiments, the substrate may be heated to a temperature of between 200 degrees Fahrenheit and 1000 degrees Fahrenheit. In other embodiments, the substrate may be heated to a temperature of between about 300 degrees Fahrenheit and about 800 degrees Fahrenheit. In yet other embodiments, the substrate may be heated to a temperature of between about 400 degrees Fahrenheit and about 600 degrees Fahrenheit.

Gaseous precursors and/or reactants (e.g., precursors or reactants containing copper molybdenum, and/or nitrogen) may be introduced into the reaction chamber. Subsequently, a radio frequency ("RF") potential or a pulsed direct current (DC) may be used to generate a plasma within the reaction chamber (e.g., in between the cathode and anode) from the gaseous precursors and/or reactants, thereby inducing a chemical reaction by which such precursors and/or reactants are transformed and deposited onto the substrate as a film in solid form (e.g., a film comprising molybdenum nitride and copper and/or copper nitride).

The process of causing the first surface and the second surface to come into contact with one another and disposing both the hydrocarbon fuel and the deposited film between the first surface and the second surface causes the film to convert at least a portion of the hydrocarbon fuel disposed between the surfaces to a high lubricity substance. The high lubricity substance may remain disposed on one or more of the surfaces as a durable tribological layer, or it may be suspended in the hydrocarbon fuel. As the hydrocarbon fuel proceeds through the engine, the high lubricity substance may come into contact with the other surfaces of the engine therein that do not have a deposited film and are not in contact with said film. When this happens, the high lubricity substance may, upon coming into contact with and/or being disposed adjacent to the other surfaces, provide to such surfaces the benefit of additional lubricity and wear protection without the requirement of a deposited film or coating. As a result, an engine can be operated continuously on low-lubricity hydrocarbon fuel without lubricating additives, nor the need for a separate lubricant recirculation system.

In another embodiment, the film may be deposited on a surface of a component of the engine, where contact between such surface and another surface results in the creation of the high lubricity substance. For example, it may be that at least a portion of a cylinder in an internal combustion, piston-driven engine is coated with the film that converts the hydrocarbon fuel into a high lubricity substance. In such an embodiment, the first surface may include an interior wall of the cylinder that has been coated with the film, and the second surface may include another component of the engine (e.g., an exterior surface of a piston and/or piston ring positioned In an interior of the cylinder) such that at least a portion of the second surface is in contact with and/or adjacent to the first surface. In an alternative embodiment, the first surface may include the exterior surface of the piston and/or piston ring that has been coated with the film, and the second surface may include the interior wall of the cylinder. The motion of the piston and the other components in the engine may then generate the high lubricity substance and transport the high lubricity substance to other areas of the engine that do not have a converting film, such as bearings or cam surfaces. When the high lubricity substance comes into contact with these other areas, the high lubricity substance reduces the friction and wear rate of the component and allows operation for extended periods of time without the need for externally added lubricating fuel additives or lubricant recirculation systems.

In yet another embodiment, the converting film used to create the high lubricity substance when in contact with the second surface is a metal nitride coating comprising of 50 to 99.7 wt. % molybdenum nitride and 50--0.3 wt. % copper or copper nitride. In such an embodiment, the high lubricity substance includes a form of graphitic carbon similar to the lubricant graphite and exhibits improved chemistry and viscosity. This graphitic carbon is initially formed from the contact between the deposited film and a counter surface. Rather than remaining disposed as a durable coating on the surface of the deposited film, the graphitic carbon is released from the surface and suspended in the hydrocarbon fuel stream, increasing the lubricity of the hydrocarbon fuel and enabling the hydrocarbon fuel to thereby act as a lubricant for other components—such as bearings for rotational components—that may or may not have a deposited film on their surface.

The systems and methods described herein provide numerous advantages over existing lubrication technologies. For instance, by tribocatalytically generating a high lubricity substance through interactions between contact surfaces and fuel, the system may provide highly durable lubrication of fuel-contacting surfaces of a machine or device (e.g., an internal combustion engine) without the need for additional lubricants (e.g., oils, greases, and/or the like) that may increase the internal friction or resistance of the machines or device (e.g., due to the higher viscosity levels of the additional lubricants.) In turn, the contacting surfaces (e.g., bearings, cams, shafts, pistons, cylinders, and/or the like) to move freely without seizing or undue wear, thereby increasing the efficiency of operation of such machines or devices. Indeed, the durability of such coatings may allow machines to be operated for short periods of time even without fuel in the crankcase. Furthermore, the relatively small size of the high lubricity substance allows the substance particles to travel (e.g., through the fuel) to various other non-coated components in the fuel path, thereby providing lubricating such non-coated components. Finally, the lack of need for additional lubricants lowers emissions and/or sulfur impact associated with running the machines.

Turning now to the figures, FIG. 1 illustrates a system for generating high-lubricity substances for lubrication of a mechanical device, in accordance with an embodiment of the present disclosure. In particular, the system may enrich a hydrocarbon-based fuel with a high lubricity substance that may be used to lubricate other surfaces within the engine. Accordingly, the system may comprise a device with a first plate 101 (which may be rotating) with a surface having a film deposited thereon (e.g., a first surface). The deposited film on the surface of the first plate 101 may come into contact with a liquid hydrocarbon fuel 102. After coming into contact with the hydrocarbon fuel 102, the surface of the first plate 101 may come into contact (e.g., sliding contact, rotating contact, and/or the like) with a surface (e.g., a second surface) of the second plate 103 (which may also be rotating). The action of the two plates rotating against one another with the fuel disposed between the first surface (on which the film is deposited) and the second surface causes at least a portion of the hydrocarbon fuel to convert to a high lubricity substance 104. The high lubricity substance 104 may be, for instance, a carbon-based substance such as a graphitic carbon. In this regard, the high lubricity substance 104 may include one or more of various allotropes of carbon, such as graphite, graphene, fullerene, diamond-like carbon ""DL""), and/or the like. In some embodiments, the high lubricity substance 104 may include IO to 100 wt. % graphitic carbon. In other embodiments, the high lubricity substance 104 may include 50 to 80 wt. % graphitic carbon.

The high lubricity substance 104, rather than being a durable tribological layer that remains disposed on either surface of the of the two plates 101, 103, may be suspended in the hydrocarbon fuel 102 and be carried within the hydrocarbon fuel 102 to other parts or components of the engine 106 within the fuel path, such as a bearing 105. When the high lubricity substance 104 comes into contact with other parts or components, such as the bearing 105, the high lubricity substance 104 forms a temporary lubricating layer on the tribological surfaces of such parts or components (e.g., the bearing 105). This temporary lubricating layer decreases the friction coefficient and decreases the wear of the components, extending component lifetime and improving component performance.

FIG. 2 illustrates the mechanism of transport of the high lubricity substance, in accordance with an embodiment of the present disclosure. In such an embodiment, a first component 202 inside of an engine (e.g., an interior portion of a cylinder, such as a cylinder wall) has a surface (e.g., a first surface) that is at least partially modified with a deposited film 204. The surface of the first component 202 comprising the deposited film 204 may be in tribological contact (e.g., sliding or rotating contact) with a countersurface (e.g., a second surface) of a second component 212 (e.g., a component in contact with at least a portion of the cylinder wall, such as a piston or piston ring). The tribological contact of the deposited film 204 with the countersurface of the second component 212 chemically reacts with liquid hydrocarbon fuel 208 to create a high lubricity substance. The high lubricity substance forms a temporary lubricating layer 206 on the deposited film 204 on the surface of the first component 202 as well as a temporary lubricating layer 210 on the countersurface of the second component 212.

The liquid hydrocarbon fuel 208, upon coming into contact with the temporary lubricating layers 206, 210 of the high lubricity substance, removes some of the high lubricity substance from the temporary lubricating layers 206, 210 and becomes an enriched liquid hydrocarbon fuel 214 (a liquid hydrocarbon fuel that has been enriched with the high lubricity substance). As the enriched liquid hydrocarbon fuel 214 moves through the engine, the enriched liquid hydrocarbon fuel 214 comes into contact with other components 216 of the engine (e.g., cam surfaces, rotating shafts, bearings, and/or the like) that may experience wear (e.g., abrasive wear, sliding wear, rolling wear, rotational wear, and/or the like), at which point the high lubricity substance within the enriched liquid hydrocarbon fuel 214 forms a temporary lubricating layer 218 on said other components 216. In some embodiments, the other components 216 may not have been modified with a deposited film 204 as with the surface of first component 202, and also may not otherwise be in contact with the deposited film 204 as with the countersurface of the second component 212. That said, because the high lubricity substance is suspended in the enriched liquid hydrocarbon fuel 214, and the enriched liquid hydrocarbon fuel 214 is brought into contact with many parts of the engine (e.g., the other components 216), the high lubricity substance forms a lubricating, wear-resistant film on the other components 216 that would not otherwise receive the lubrication needed for long-term operation. As such, the system and method described herein allows the engine to continue to run even in the absence of additional lubrication to the other components 216. It should be understood that the foregoing embodiment is provided for exemplary purposes and is not intended to restrict the scope of the disclosure provided herein. For instance, in other embodiments, a piston of the internal combustion engine (or any other components with wearing surfaces) may be coated with the film 204 instead of the interior of the cylinder. Furthermore, it is within the scope of the disclosure for multiple components of the engine to be coated with the film 204.

EXAMPLE

A film comprising copper and molybdenum nitride was deposited on the inner surface of an internal combustion engine cylinder. This engine was reassembled and operated using only aviation turbine fuel (Jet A), such that unburned fuel was recirculated into the crank case and applied to the bearings therein. No oil or additive of any kind was supplied to provide lubrication. The engine was operated in this fashion for 500 hours, at which time the bearings, which received no coating, were inspected. During inspection, the interior surfaces of the engine were shown to be coated with a thin film of poorly adhered graphitic carbon. Despite the extended operation without lubrication, the bearings showed no signs of excessive wear. Properties of the effluent fuel (crankcase effluent) were also tested.

FIG. 3 illustrates a method 300 for generating high-lubricity substances for lubrication of a mechanical device, in accordance with an embodiment of the disclosure. As shown in block 302, the method includes providing a first component operatively coupled to the mechanical device, wherein the mechanical device is an engine, the first component comprising a surface having a film deposited thereon. In an exemplary embodiment, the first component may be coated with a film comprising copper and/or molybdenum nitride using a technique such as PECVD. In some embodiments, the high lubricity substance may be a graphitic carbon that is generated when the surface of the film comes into contact with or is proximate to a moving (e.g., rotating, sliding, and/or the like) countersurface of a third component operatively coupled to the engine while the fuel is in between or proximate to the surface of the film and the countersurface. The first component may be, for instance, an internal and/or integral component of the engine such as a cylinder wall of an internal combustion engine and the third component may be a component such as a piston or piston ring that may be in contact with or proximate to the interior of the cylinder (e.g., the cylinder wall). In such an embodiment, the high lubricity substance may be created during the ordinary operation of the engine. For instance, the fuel may be introduced into the cylinder such that the fuel contacts the interface between the piston or piston ring and the cylinder wall. Thus, when the piston or piston ring is in contact with or proximate to the cylinder wall and slides up and down the cylinder wall in a reciprocating motion, the high lubricity substance is formed on the surface of the film on the cylinder wall.

In other embodiments, the first component may be a part of a separate device that may be operatively connected to the engine (e.g., a device built specifically to generate the high lubricity substance that may not necessarily be dependent on the operation of the engine). In such embodiments, the first component may be a first rotating plate within the device, where a surface of the first rotating plate has been coated with the copper and/or molybdenum film. The device may comprise a second rotating plate (e.g., the third component), where a surface of the second rotating plate may be proximate to or in rotational and/or sliding contact with the film deposited on the first rotating plate (a countersurface to the surface of the first plate). In some embodiments, a pump may be used in place of the second rotating plate. The first rotating plate and the second rotating plate may be located within the path of the fuel circulated by the fuel delivery system of the engine, such that the fuel passes in between the surface of the first rotating plate containing the film and the countersurface of the second rotating plate such that the high lubricity substance is formed on the surface of the film of the first rotating plate. In some embodiments, the device may be located internal to the engine (e.g., within the housing of the engine). In other embodiments, the device may be located external to the engine (e.g., affixed to a mount outside of the engine) while still remaining at least partially within the fuel path of the fuel delivery system of the engine.

Next, as shown in block 304, the method includes operating the engine on a fuel, wherein operating the engine comprises exposing the film to the fuel to generate the high lubricity substance on the surface of the film. As the internal combustion is operated, the fuel (e.g., a hydrocarbon fuel such as gasoline, diesel, jet fuel, and/or the like) may come into contact with the film on the surface of the first component and/or the countersurface of the third component. In this regard, the hydrocarbon fuel may be located in between the surface of the first component and the countersurface of the third component. As the hydrocarbon fuel interacts with the first component and/or the third component (e.g., through mechanical sliding or rotating contact between the first component and the third component), at least a portion of the hydrocarbon fuel may be converted into the high lubricity substance (e.g., a graphitic carbon), which may be formed on the surface of the film of the first component.

Next, as shown in block 306, the method includes suspending at least a portion of the high lubricity substance within the fuel. The high lubricity substance may be weakly adhered to the film of the first component such that fluid motion of the fuel is sufficient to remove some of the high lubricity substance from the film of the first component as the fuel contacts the top layer of the high lubricity substance. The particles of the high lubricity substance that were removed by fluid motion of the fuel may then be suspended in the fuel such that the particles may then be carried to various other parts of the engine along the fuel path during operation of the engine.

Next, as shown in block 308, the method includes conveying, via the fuel, the at least a portion of the high lubricity substance to a second component operatively coupled to the engine. As stated previously, the high lubricity substance, which has been suspended in the fuel, may be carried to various other components in the engine through fluid movement of the fuel throughout the fuel delivery system. For example, the second component may be a component that experiences wear (e.g., frictional contact with other components or surfaces). In this regard, the second component may be a component such as a bearing, rod or shaft surfaces (e.g., crankshafts, camshafts, and/or the like), a valvetrain component, cam surface, turbine, and/or the like. In some embodiments, the second component may be an untreated component that has not been treated with a film (e.g., the copper and/or molybdenum nitride coating) or additional lubricant (e.g., an oil or grease).

Next, as shown in block 310, the method includes lubricating the second component using the at least a portion of the high lubricity substance. In this regard, the high lubricity substance suspended in the fuel may at least partially coat and/or adhere to a surface of the second component. Accordingly, as the second component comes into contact with another structure or component (e.g., a fourth component), the high lubricity substance may be positioned between the second component and the fourth component to provide lubrication for the interface between the second component and the fourth component. As the engine continues to run, the high lubricity substance may continuously be generated from the fuel (e.g., through the moving contact between the first component and the third component) and subsequently be continuously transported to other, untreated components to provide lubrication thereto. In this way, the method described herein may allow an engine to continue to run without its components experiencing undue friction and wear, even in the absence of additives or additional lubricants.

FIG. 4 shows a plot of the viscosity versus shear rate for a fuel that has not been used in the claimed method (Fresh Jet A) and for the crankcase effluent produced in accordance with an exemplary embodiment of the claimed invention (crankcase effluent). The x-axis represents the rate at which the fluid is deformed and the y-axis represents the fluid's resistance to flow. The line corresponding to Fresh Jet A 404 and the line corresponding to the crankcase effluent 402 show that the viscosity decreases as the shear rate increases. This property is known as shear thinning. The steeper the slope of the line, the more pronounced the shear-thinning behavior. The shear thinning of the crankcase, as shown in 402 is greater than the shear thinning of the Fresh Jet A, as shown in 404. As shear rate increases, the drop in viscosity is more pronounced for the crankcase effluent 402 than for the Fresh Jet A 404.

In an exemplary embodiment of the claimed invention, the high lubricity substances formed in the effluent comprise graphene oxide. The SEM image 500 of high lubricity substances in an effluent are visually consistent with graphene oxide. In SEM images, graphene oxide appears as a network of thin, often crumpled sheets with irregular edges and textured surfaces. The sheets can aggregate into clusters, and their appearance can vary based on synthesis methods and conditions.

Energy-dispersive X-ray spectroscopy (EDX) provides elemental composition information of the high-lubricity substances by detecting the X-rays emitted from a sample when it is irradiated with an electron beam. EDX testing of the effluent in an exemplary embodiment of the claimed invention supports the formation of graphene oxide. The EDX test results show a significant presence of oxygen in addition to carbon, indicating the presence of graphene oxide rather than pure graphene.

The effluent was analyzed by x-ray diffraction, the results of which are shown in FIG. 6. The experimental setup utilized a SmartLab goniometer. The X-ray source operated at 40 kV and 44 mA, using Cu K$\alpha$ radiation with a wavelength of 1.541862 Å. The SC-70 detector was used to capture the diffraction patterns, with the sample mounted on a standard Z stage. The optics configuration followed the Bragg-Brentano focusing geometry.

The experiment was conducted in STEP scan mode with a duration time of 5.0 seconds per step and a scan step size of 0.0500 degrees. The scan axis was Theta/2-Theta, covering a scan range from 5.0000 to 90.0000 degrees. The starting 2-Theta angle was set at 5.0000 degrees, and Omega was set at 2.5000 degrees.

The configuration included a BB CBO selection slit, a Soller slit with an angle of 5.0 degrees for the incident parallel slit, and an incident slit of ⅔ degrees. A length limiting slit of 10.0 mm was used, along with a receiving slit #1 of ⅔ degrees. The receiving optical device was PSA_open, with a receiving parallel slit also set to a Soller slit of 5.0 degrees and a receiving slit #2 of 0.600 mm. No filter was applied, and an attenuator with a factor of 1/10000 was used.

The diffracted beam monochromator was configured to be bent, and the monochromator slit was set to BBM. The peak produced by the XRD scan provides crucial information regarding the interlayer spacing and the degree of oxidation of the high lubricity substances in the effluent.

Cross-referencing the EDX and XRD data, a high oxygen content from EDX combined with the specific XRD peak pattern supports the identification of graphene oxide as existing in the high lubricity substances.

The lubricating properties of distillate motor fuels originate from surface-active compounds in petroleum, especially heavy aromatic compounds such as polycyclic aromatic hydrocarbons (PAH) and nitrogen-containing polyaromatic hydrocarbons (NPAH) that have three or more fused rings.

In an exemplary embodiment of the present invention, the concentration of monoaromatic compounds in the high lubricity substance is less than 16% by mass, preferably less than 15.8% percent by mass, and most preferably less than 15.6% by mass.

In an exemplary embodiment of the present invention, aromatic content was measured using Supercritical Fluid Chromatography (SFC), ASTM D5186 for Jet Fuel A and an effluent stream of fuel containing the high lubricity substances. No observable chromatography differences in functional chemical composition were observed. The compositions determined by SFC for each of the two fluids are shown below. The reporting limit (RL) is the value at or above which a result is routinely reported. The dilution factor (DF) is the dilution applied to the sample during analysis to arrive at the final reported analyte result.

Aromatic Hydrocarbons by ASTM D5186 [A] for Jet Fuel A

| | Result | Unit | RL | DF |
|---|---|---|---|---|
| Monoaromatics | 16.2 | % m/m | 0.5 | 1 |
| Polynuclear aromatics | 1.2 | % m/m | 0.5 | 1 |
| Predicted D1319 aromatics | 15.3 | % v/v | 1 | 1 |
| Total aromatics | 17.4 | % m/m | 1 | 1 |

Aromatic Hydrocarbons by ASTM D5186 [A] for Effluent Fuel

| | Result | Unit | RL | DF |
|---|---|---|---|---|
| Monoaromatics | 15 | % m/m | 0.5 | 1 |
| Polynuclear aromatics | 2.1 | % m/m | 0.5 | 1 |
| Predicted D1319 aromatics | 15.7 | % v/v | 1 | 1 |
| Total aromatics | 17.7 | % m/m | 1 | 1 |

Comparing the chromatography results of Jet Fuel A and the effluent fuel analyzed in the example above, Jet Fuel A has higher monoaromatic content but lower polynuclear aromatic content compared to the effluent fuel.

By increasing the PAH content from 1.2% to 2.1%, a dramatic decrease in wear was observed.

The kinematic viscosity (Kv) of the two fluids was measured using ASTM standard D-445 and reported at temperatures of 40° C., with the following results:

Jet Fuel A: 1.368 $mm^2/s$

Effluent Fuel: 1.834 $mm^2/s$

The effluent fuel has a higher total aromatic content and viscosity, suggesting it may be a more complex or heavier aromatic mixture.

In an exemplary embodiment, tribological tests were performed using ASTM D6079. Specifically, the fuel's lubricity was evaluated by using a high-frequency reciprocating rig (HFRR) to simulate the friction and wear conditions that occur in diesel engines. The test measures the wear scar diameter on a steel test specimen to assess the fuel's effectiveness in reducing friction and preventing wear.

In an exemplary embodiment, the reaction catalyzed by the claimed film produced $3^{rd}$ bodies in the effluent fuel. The tribological testing of Jet Fuel A and the effluent fuel indicated that the $3^{rd}$ bodies could reduce wear by up to two orders of magnitude. When the $3^{rd}$ bodies were filtered out of the fuel, tribological testing of the two fluids revealed that the effluent fuel caused reduced wear and half the friction of the Jet A Fuel.

The filtered effluent fuel was also analyzed using Raman spectroscopy and dynamic light scattering.

In one embodiment of the present invention, the claimed film causes a catalytic reaction when it contacts fuel, converting monoaromatics into polynuclear aromatics. These polynuclear aromatics bond to the surface of the uncoated mechanical components to produce an increase in lubricity and decreasing wear on the surface of those components.

As will be appreciated by one of ordinary skill in the art, the present disclosure may be embodied as an apparatus (including, for example, a system, a machine, a device, a computer program product, and/or the like), as a method (including, for example, a business process, a computer-implemented process, and/or the like), as a computer program product (including firmware, resident software, microcode, and the like), or as any combination of the foregoing. Many modifications and other embodiments of the present disclosure set forth herein will come to mind to one skilled in the art to which these embodiments pertain having the benefit of the teachings presented in the foregoing descriptions and the associated drawings. Although the figures only show certain components of the methods and systems described herein, it is understood that various other components may also be part of the disclosures herein. In addition, the method described above may include fewer steps in some cases, while in other cases may include additional steps. Modifications to the steps of the method described above, in some cases, may be performed in any order and in any combination.

Therefore, it is to be understood that the present disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method for generating high-lubricity substances for lubrication of a mechanical device, the method comprising:

providing a first component operatively coupled to the mechanical device, the first component comprising a surface having a film deposited thereon;

operating the mechanical device using a hydrocarbon-based fluid, wherein operating the mechanical device comprises exposing the film to the hydrocarbon-based fluid to generate the high lubricity substance on a surface of the film;

suspending at least a portion of the high lubricity substance within the hydrocarbon-based fluid;

conveying, via the hydrocarbon-based fluid, the at least a portion of the high lubricity substance to a second component operatively coupled to the mechanical device; and lubricating the second component using the at least a portion of the high lubricity substance.

2. The method of claim 1, wherein generating the high lubricity substance on the surface of the film further comprises:

positioning the hydrocarbon-based fluid between the film on the surface of the first component and a surface of a third component operatively coupled to the mechanical device; and bringing the film on the surface of the first component into contact with the surface of the third component.

3. The method of claim 1, wherein the first component is housed in a device that is operatively coupled to the mechanical device.

4. The method of claim 3, wherein the device is located outside of the mechanical device, wherein the first component is located substantially within a path of a hydrocarbon-based fluid delivery system of the mechanical device.

5. The method of claim 1, wherein the high lubricity substance is a suspension comprising one or more allotropes of carbon.

6. The method of claim 1 wherein the film comprises a metal M selected from a group consisting essentially of the metals Cu, Ni, Sc, Y, Ti, Zr, Hf, V, Nb, Ta, Cr, Mo, Ag, Au, Pd, Zn, Cd, Hg, Al, Ga, In, Pt, and W, and combinations thereof.

7. The method of claim 1 wherein the film comprises copper and molybdenum nitride with a ratio of copper to molybdenum of between 1:3 and 1:2.

8. A high lubricity substance comprising one or more allotropes of carbon wherein the high lubricity substance is generated on the surface of a film when the film is exposed to a hydrocarbon-based fluid.

9. The high lubricity substance of claim 8 wherein the film is deposed on the surface of a component of a mechanical device, the mechanical device comprising:

a first component operatively coupled to the mechanical device, an inlet stream of a hydrocarbon-based fluid;

an effluent comprising:

the hydrocarbon-based fluid; and a suspension of at least a portion of the high lubricity substance in the hydrocarbon-based fluid.

10. The high lubricity substance of claim 8 wherein the high lubricity substance further comprises graphitic structures in the hydrocarbon-based fluid.

11. The high lubricity substance of claim 8 wherein the film comprises a metal M selected from a group consisting essentially of the metals Cu, Ni, Sc, Y, Ti, Zr, Hf, V, Nb, Ta, Cr, Mo, Ag, Au, Pd, Zn, Cd, Hg, Al, Ga, In, Pt, and W, and combinations thereof.

12. The high lubricity substance of claim 8 wherein the film comprises copper and molybdenum nitride with a ratio of copper to molybdenum of between 1:3 and 1:2.

13. The high lubricity substance of claim 9 further comprising a concentration of monoaromatics in the effluent that is less than the concentration of monoaromatics in the hydrocarbon-based fluid at the inlet stream of the mechanical device.

14. The high lubricity substance of claim 9 further comprising a concentration of polynuclear aromatics in the effluent that is greater than the concentration of the polynuclear aromatics in the hydrocarbon-based fluid at the inlet of the mechanical device.

15. The high lubricity substance of claim 9 wherein the effluent comprises a fluid with higher viscosity than the hydrocarbon-based fluid at the inlet of the mechanical device.

16. A system for generating high-lubricity substances for lubrication of a mechanical device, the system comprising:

the mechanical device, wherein the mechanical device is an engine;

a first component operatively coupled to the engine, wherein a surface of the first component has a film deposited thereon;

a second component operatively coupled to the engine, wherein the second component comprises a surface in moving contact with a surface of the film; and a third component operatively coupled to the engine;

wherein the film, when placed into contact with the second component with a hydrocarbon-based fluid positioned between a surface of the film and the surface of the second component, generates a high lubricity substance on a surface of the film;

wherein at least a portion of the high lubricity substance is suspended in the hydrocarbon-based fuel in the engine.

17. The system of claim 16, wherein the first component and the second component are housed in a device that is operatively coupled to the engine.

18. The system of claim 17, wherein the device is located outside of the engine, wherein the first component and the second component are located substantially within a fuel path of a fuel delivery system of the engine.

19. The system of claim 16, wherein the high lubricity substance is a suspension comprising one or more allotropes of carbon.

20. The system of claim 16 wherein the film comprises a metal M selected from a group consisting essentially of the metals Cu, Ni, Sc, Y, Ti, Zr, Hf, V, Nb, Ta, Cr, Mo, Ag, Au, Pd, Zn, Cd, Hg, Al, Ga, In, Pt, and W, and combinations thereof.

* * * * *